US010741023B2

(12) United States Patent
Rader et al.

(10) Patent No.: US 10,741,023 B2
(45) Date of Patent: Aug. 11, 2020

(54) MARKETING BONUS SYSTEM AND METHOD

(71) Applicant: Umpqua Indian Development Corporation, Roseburg, OR (US)

(72) Inventors: Richard Michael Rader, Roseburg, OR (US); Shawn R McDaniel, Roseburg, OR (US)

(73) Assignee: Umpqua Indian Development Corporation, Roseburg, OR (US)

( * ) Notice: Subject to any disclaimer, the term of this patent is extended or adjusted under 35 U.S.C. 154(b) by 0 days.

(21) Appl. No.: 16/373,577

(22) Filed: Apr. 2, 2019

(65) Prior Publication Data

US 2019/0287342 A1 Sep. 19, 2019

Related U.S. Application Data

(63) Continuation-in-part of application No. 15/216,904, filed on Jul. 22, 2016, now Pat. No. 10,282,944.

(51) Int. Cl.
*G07F 17/00* (2006.01)
*G07F 17/32* (2006.01)

(52) U.S. Cl.
CPC ..... *G07F 17/3255* (2013.01); *G07F 17/323* (2013.01); *G07F 17/3239* (2013.01); *G07F 17/3272* (2013.01)

(58) Field of Classification Search
None
See application file for complete search history.

(56) References Cited

U.S. PATENT DOCUMENTS

| | | | |
|---|---|---|---|
| 6,206,782 | B1 | 3/2001 | Walker et al. |
| 6,328,248 | B1 | 12/2001 | Kaipf |
| 6,375,569 | B1 | 4/2002 | Acres |
| 6,626,758 | B1 | 9/2003 | Parham et al. |
| 6,786,824 | B2 | 9/2004 | Cannon |
| 6,984,174 | B2 | 1/2006 | Cannon et al. |

(Continued)

OTHER PUBLICATIONS

Office Action for U.S. Appl. No. 15/216,904 dated Oct. 4, 2018; 10 pps.

(Continued)

*Primary Examiner* — Paul A D'Agostino
(74) *Attorney, Agent, or Firm* — Fincham Downs LLC; Magdalena M. Fincham, Esq.

(57) ABSTRACT

A marketing bonus system and method for use in one or more casino establishments for awarding a prize to a player who is a member of a loyalty program and has a player card in active use at an eligible electronic gaming machine. The marketing bonus system and method randomly selects a player for an award. It may be configured to offer multiple bonuses across the floor of a casino or other gaming establishment at any given time. Players are notified prior to a bonus being awarded so that they may insert their card into an electronic gaming machine on the casino floor in the area where the bonus is active and be eligible to win. Awards are offered to eligible players at electronic gaming machines such as slot machines and video poker machines, but may also be offered on other types of devices that are in active use such as general purpose computing devices connected to the system over a network such as the internet.

23 Claims, 9 Drawing Sheets

(56) References Cited

U.S. PATENT DOCUMENTS

| | | | | |
|---|---|---|---|---|
| 2005/0130732 | A1* | 6/2005 | Rothschild | G07F 17/32 463/20 |
| 2005/0215314 | A1* | 9/2005 | Schneider | G07F 17/32 463/26 |
| 2005/0215316 | A1 | 9/2005 | Rowe et al. | |
| 2006/0160620 | A1 | 7/2006 | Matthews et al. | |
| 2012/0172130 | A1 | 7/2012 | Acres | |

OTHER PUBLICATIONS

Notice of Allowance for U.S. Appl. No. 15/216,904 dated Jan. 9, 2019; 8 pps.

* cited by examiner

400

| | | Configuration Screen | |
|---|---|---|---|
| Line 1 | | Bonus Name | $25 Max Winner Amount |
| Line 2 | | Bonus Award Amount Minimum | $1.00 |
| Line 3 | | Bonus Award Amount Maximum | $25.00 |
| Line 4 | | Bonus Status | Active |
| Line 5 | | Device Enrollment | 10001,10002,10003 |
| Line 6 | | Device Enrollment Type | Location Codes |
| Line 7 | | Device Enrollment Description | Use Location Codes for Enrolled Devices |
| Line 8 | | Pre-Notification Minimum Time | 20 |
| Line 9 | | Pre-Notification Maximum Time | 100 |
| Line 10 | | Notification Minimum Time | 2 |
| Line 11 | | Notification Maximum Time | 4 |
| Line 12 | | Bonus Trigger Name | Every 20 Minutes Minimum |
| Line 13 | | Bonus Trigger Period Minimum | 20 |
| Line 14 | | Bonus Minimum Time | 01/01/2016 |
| Line 15 | | Bonus Maximum Time | 01/01/2020 |

FIG. 4

500

| | Enrollment Screen | |
|---|---|---|
| Line 1 | Bonus Name | $25 Max Winner Amount |
| Line 2 | Enrollment Denom | * |
| Line 3 | Enrollment Location | * |
| Line 4 | Enrollment Manufacturer | * |
| Line 5 | Enrollment PAR | * |
| Line 6 | Enrollment GameType | Slot |
| Line 7 | Enrollment DisplayType | Video |
| Line 8 | Enrollment Leased Machine | No |
| Line 9 | Enrollment Description | * |
| Line 10 | Enrollment Asset ID | * |

FIG. 5

600

| Activate Screen | |
|---|---|
| Bonus Name | $25 Max Winner Amount |
| Monday Start Time | 00:00.0 |
| Tuesday Start Time | 00:00.0 |
| Wednesday Start Time | 00:00.0 |
| Thursday Start Time | 00:00.0 |
| Friday Start Time | 00:00.0 |
| Saturday Start Time | 00:00.0 |
| Sunday Start Time | 00:00.0 |
| Monday End Time | 23:59.59 |
| Tuesday End Time | 23:59.59 |
| Wednesday End Time | 23:59.59 |
| Thursday End Time | 23:59.59 |
| Friday End Time | 23:59.59 |
| Saturday End Time | 23:59.59 |
| Sunday End Time | 23:59.59 |

Line 1
Line 2
Line 3
Line 4
Line 5
Line 6
Line 7
Line 8
Line 9
Line 10
Line 11
Line 12
Line 13
Line 14
Line 15

FIG. 6

700

| | | Bonus Monitor Screen | |
|---|---|---|---|
| Line 1 | | Bonus Name | $25 Max Winner Amount |
| Line 2 | | Current Bonus ID | XXXX |
| Line 3 | | Prenotification Time | 07/01/2016 05:56 |
| Line 4 | | Award Time | 07/01/2016 06:00 |
| Line 5 | | Min Distinct Cards | 5 |
| Line 6 | | Device Enrollment | <view_machine Mnum="14305" PAI="11433" Denom="0.0100" MtrDenom="0.0100" MFR="IGT" Description="MULTI GAME-MD 5-17" Par="10.480" GameType="POKER" DisplayType="VIDEO" MachineTypeId="1402" UniqueId="4025821" SectionName="01" Bank="15" Location="02" Maxcoins="80" Validator="Y" Status="A" CabinetType="UPRIGHT" Model="GAME KING" BankController="2_33 " Jpx="1" Ptrack="Y" PayMethod="B" PayLines="1" ReelStops="0" InitialFill="0" FillAmount="0.0000" MaxJP="10000.0000" Serialnum="1305566" Eprom="M0001055" PurchaseDate="2003-12-29T00:00:00" StartDate="2014-12-03T00:00:00" CabinetNumber="14305 " BagsPerFill="0" CurrentBagsInAuxFill="0" MaxBagsInAuxFill="0" HopperLevelAdjustment="0" ManualMeters="N" AmountPerBag="60000.0000" CoininCount="500" PointCount="3" MachineLocation="011502" SealNumber="0" FirstCoinPercent="5.17" MaxCoinPercent="5.17" PTType="PO" HoldPercent="10.48" TicketPrinter="Y" LeasedMachine="N" CoinInPercent="0.00" NetWinPercent="0.00" ActualAmount="0.0000" TicketParser="0" Protocol="SAS" AuxFillPrintLoc="0" HasTicketMeters="Y" GL_Code="0" HopperVarianceLimit="0" MtrMoney="0.0100" TicketsIncDropMtr="Y" TicketType="2" WATInIncDropMtr="N" MDMG="N" Coinless="Y" SBG="N" LargestLeaseAmount="N" WATEnabled="0" EGMEnabled="1" EGMID="IGT_0004025821" VoucherDataExists="Y" BillsNotInTotalDrop="N" /> |
| Line 7 | | Current Floor View | <BonusPAT Location="062803 " PlayerID="350183" CardInTime="2016-06-14T05:55:12.380" CardID="40432165004715826856" LockID="40118636" FirstName="RONALD" LastName="RUSHFORD JR" description="AH - Silver" /> |
| Line 8 | | Winner PlayerID | TBD |
| Line 9 | | Winner Name | TBD |
| Line 10 | | Winner Location | TBD |
| Line 11 | | Winner Amount | $25.00 |
| Line 12 | | Winner Award Date Time | TBD |
| Line 13 | | Bonus Status | Active |
| Line 14 | | Last Update to Record | 07/01/2016 04:45 |
| Line 15 | | Bonus Maximum Time | 01/01/2020 |

FIG. 7

MARKETING BONUS SYSTEM AND METHOD

CLAIM OF PRIORITY

This application is a Continuation-In-Part of U.S. patent application Ser. No. 15/216,904 filed on Jul. 22, 2016 in the name of Rader et al. and titled MARKETING BONUS SYSTEM AND METHOD. The entirety of this Application is incorporated by reference herein for all purposes.

COPYRIGHT NOTICE

Portions of this disclosure contain material in which copyright is claimed by the applicant. The applicant has no objection to the copying of this material in the course of making copies of the application file or any patents that may issue on the application, but all other rights whatsoever in the copyrighted material are reserved.

BACKGROUND

Electronic gaming machines ("EGMs") offer a variety of games such as slot games, video poker games, roulette games, keno games and other types of wagering games that are commonly deployed at a casino for use by players. A typical prior art EGM is shown in FIG. 1. Play on the EGMs typically requires the player to place a wager on the outcome of a primary game with the possibility of winning an award based on a paytable for the particular game. On many such EGMs, secondary games or bonus rounds are also available after the player qualifies by attaining a certain winning combination at the end of the game or event, or based on other requirements related to the primary game. If the player meets the requirements, upon completion of the base game, the player enters the secondary game or bonus round where they have an opportunity to win extra game credits, game tokens or other awards. For example, the player might automatically enter the secondary game or bonus round upon achieving a winning game outcome, or alternatively, when a bonus symbol appears in a predetermined position on the reels of a slot game (or the game display of another type of game) upon completion of the game. The player may be awarded credits for winning the base game and then additional credits for winning the secondary game.

In addition to bonus games offering players opportunities to win awards, other wager dependent awards such as progressive prizes may also be available to a player. Progressive prize opportunities are well known in the art and are typically available if an additional wager is placed before the start of the game for the player to be eligible for the progressive prize. Progressive systems offer a prize value that "progresses" or grows with the play of each game, with a portion of the amount wagered for each game being contributed to the progressive prize across multiple EGMs connected to the progressive system until the prize is won. Progressive systems such as IGT's Megabucks® and Wheel of Fortune® progressives have been in operation for many years in Nevada and other legal gaming jurisdictions around the world.

In addition, it is known to configure progressive prizes for random wins either during or after a game where a player is not required to place an additional wager to be eligible for a progressive prize. Such a system is disclosed in U.S. Pat. No. 6,626,758 to Gaming Enhancements, Inc.

It is common for EGMs in a casino establishment to be connected to a player tracking system so that the casino can keep track of the amount of play by each individual player. Each player joining a "frequent player" or loyalty program is issued a player tracking device such as a card that is inserted into a card slot 105 on EGM 100 for the duration of play. The card identifies the player to the system and all wagered amounts are tracked for loyalty rewards and other marketing programs of the casino. Slot accounting systems connecting EGMs 100 are used for accounting purposes so that a casino operator can monitor and track play, and assess performance of EGMs across the entire casino floor.

Historically, the format of game play where a winning combination on a base game entitles a player to a secondary or bonus round as well as placing an additional wager for the opportunity to win a progressive award have worked well for players and gaming establishments. They generate player excitement and maintain the interest of the player. Bonusing systems for winning prizes are constantly evolving, and gaming operators and players alike are always eager to try new and innovative games and systems that offer the opportunity to award prizes.

The present invention is a marketing bonusing system and method that is configured across a network of EGMs. The system operates in parallel with other systems including player tracking, progressive bonusing systems, server based gaming systems, EGM accounting and/or other systems that deliver game content or relate to game play and data recordal/management. Unlike progressive systems or other bonusing systems related to game play, the present invention provides an opportunity for a player to be eligible for an award or prize based on a player's active participation in gaming activities at an EGM confirmed through the use of a player tracking or other identification card. In this way, a player who is a member of the establishment's loyalty program is eligible for special marketing rewards and is provided with special opportunities to receive rewards not available to the general population of players.

As is typical for a player seeking to be entertained in a gaming establishment, the player locates an EGM hosting a game that he has decided to play. Once stationed in front of the EGM, the player, who is a member of the loyalty program for the gaming establishment (or another special group) also inserts his player card into a slot on the EGM so that all game play is tracked and eligible for marketing rewards, special offers, etc. The player then loads credits on the EGM for play by inserting bills in a bill validator, or through loading credits using a card of one form or another. The player then begins play by placing a wager and hitting the "play" button. A random number generator on the EGM generates an outcome and that outcome is displayed on the EGM display to the player. In the event the outcome is a winning combination, the player is awarded a prize in accordance with the EGM pay table. If a bonus game is available and the player has met the requirements for bonus play, the player is given one or more additional opportunities to win a prize. Throughout the game play cycle and as long as the player has his player tracking or loyalty program card present in the receiving slot on the EGM, the player may be eligible for additional marketing awards that are not dependent on game play, coin-in or other game related activities on the EGM.

In one embodiment of the invention, players playing EGMs in the system are notified during a predetermined "advance period" that a random selection of a player to win an additional marketing award will be made.

BRIEF DESCRIPTION OF THE DRAWINGS

For a better understanding of the present invention, and to more clearly describe functionality, reference will now be made, by way of example, to the accompanying drawings. The drawings show embodiments of the present invention in which:

FIG. 4 is a sample configuration screen available to an operator of the marketing bonus system to set up bonusing events on the electronic marketing bonus system;

FIG. 5 is a sample enrollment screen available to an operator for setting criteria for eligibility for a particular electronic gaming machine to be eligible to win;

FIG. 6 is a sample activate screen available to an operator for setting time criteria for particular bonuses on a marketing bonus system;

FIG. 7 is a bonus monitor screen available to an operator for monitoring the status of bonuses on a marketing bonus system;

DETAILED DESCRIPTION OF EMBODIMENTS

Figure 1:
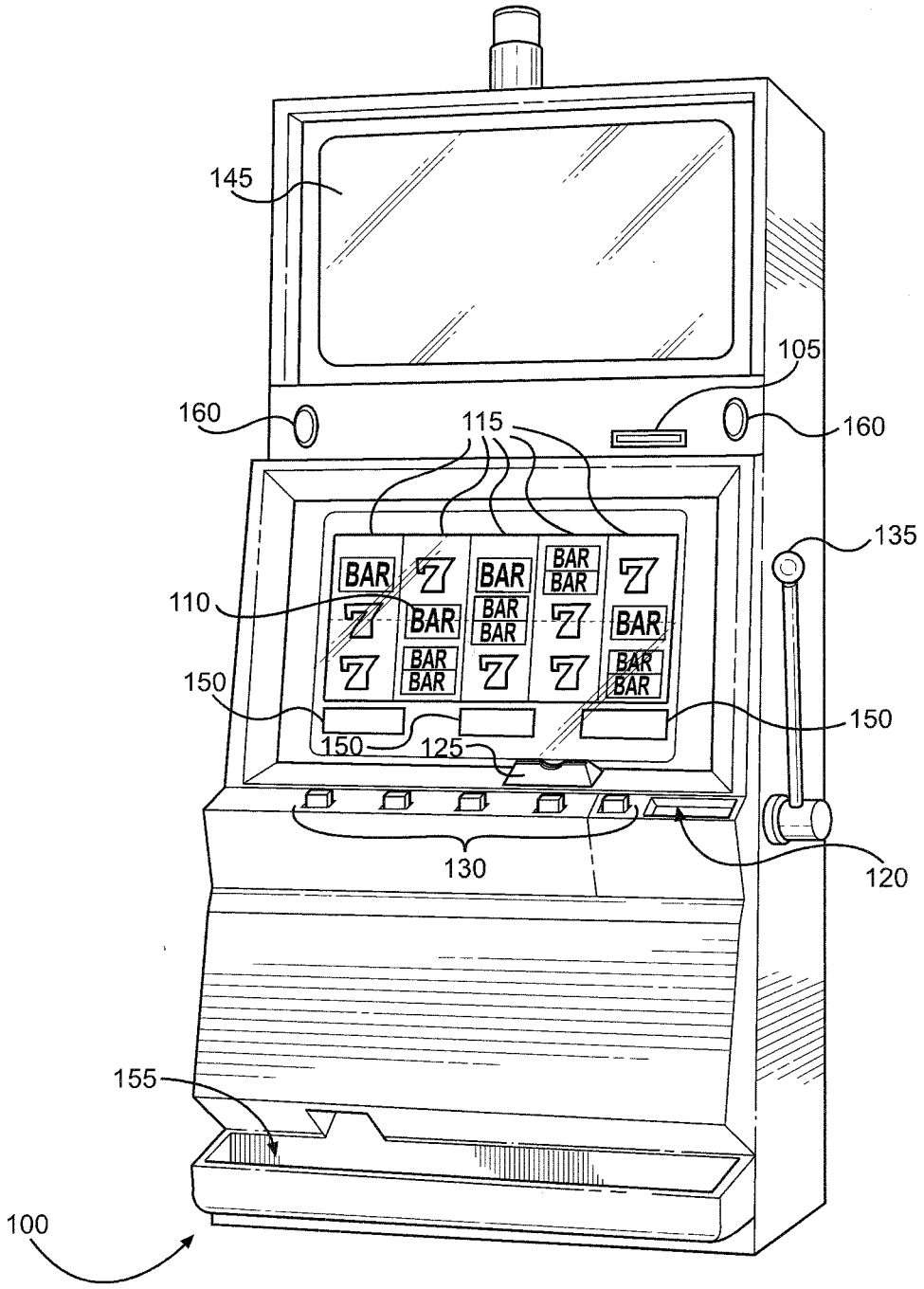
FIG. 1 PRIOR ART
FIG. 1 is a prior art electronic gaming machine of the type for use in a marketing bonus system and method.

Various embodiments of the present invention will now be described more fully with reference to the accompanying drawings. It should be understood that the invention may be embodied in many different forms and should not be construed as limited to the embodiments set forth herein. Throughout FIGS. 1-9, like elements of the various embodiments of the invention are referred to by the same reference numerals for consistency purposes.

FIG. 1 is a prior art electronic gaming machine ("EGM") 100 with a number of components that is used with the marketing bonus system of at least some embodiments of the present invention. A primary display 110 is used to show game play and resulting outcomes, and may be in the form of a video display (shown), or alternatively, physical reels. Touch screen displays are included on most EGMs and provide a flexible interface for operation of EGM 100, including displaying symbols during game play. Other components include a bill validator (see FIG. 2) housed inside EGM 100 into which bills may be inserted through bill slot 120. Buttons 130 on the exterior of EGM 100 are used to initiate and control EGM operations in conjunction with touch screen display 110 by the player. EGMs may further include a secondary display 145 for displaying other game functions including bonus screens. Either of primary display 110 or secondary display 145 may be used to show information to the player such as game play activity, pay tables, messages, advertising, entertainment screens or other types of content and/or information. Multiple meters 150 on display 110 are used for tracking credits available for play, amount won on a particular play, number of coins bet and other amounts are typically positioned near the bottom of screen 110.

EGM 100 may also accept coins at coin head 125. In those cases, a coin tray 155 at the bottom of EGM 100 is used to catch coins as they are dispensed to a player. An optional handle 135 for starting game play may also be included to simulate a historical mechanical handle of an EGM. Speakers 160 produce sound to accompany game play and other functions on EGM 100.

Figure 2:
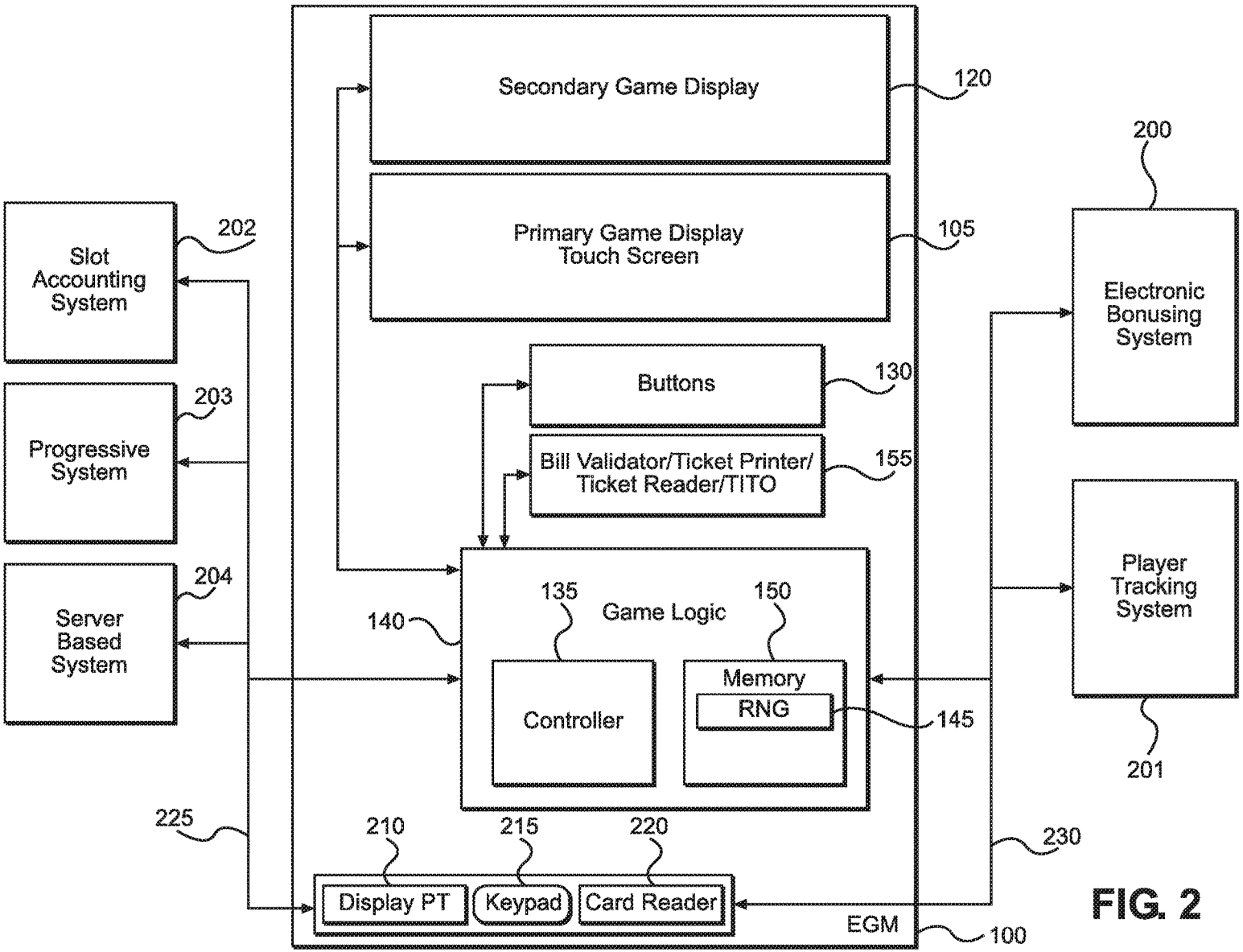
FIG. 2 is a block diagram of an electronic gaming machine for playing a game and configured to be connected to external systems over a network including an external marketing bonus system.

FIG. 2 is a block diagram of EGM 100 connected to a group of external systems including a marketing system that is an electronic bonusing system ("EBS") 200, which is also known as an electronic marketing award system. For purposes of this description, the terms "bonusing system," "electronic bonusing system," "marketing system" and "award system" are used interchangeably herein to refer to EBS 200. It should be understood that the term "bonus" or "bonusing" when referring to EBS 200 is an award that is in addition to, or as a bonus beyond any award to the player during regular game play.

Other external systems connected to EGM 100 may include, in accordance with some embodiments, a player tracking system 201, a slot accounting system 202, a progressive system 203 and a server based system 204. A number of internal components of EGM 100 are also shown, although not required for all embodiments. All operational functions of EGM 100 are controlled by a controller 135 such as a microprocessor housed inside EGM 100 that is resident in game logic 140. Controller 135 executes instructions that include operation of an EGM based random number generator 145 ("RNG") that is typically implemented in software and stored in a memory 150. The internal components of EGM 100 are well known to those of ordinary skill in the art. Game outcomes for the primary game of the EGM 100 may be determined, for example, based on the random numbers selected by local RNG 145. In another embodiment, a central system (not shown) may generate game outcomes for a group of EGMs and deliver game outcomes to a group of EGMs connected over a network.

It should be understood that software or firmware may be in the form of a computer program that is a sequence of executable instructions provided in one or more computer readable medium or other storage medium. Examples of computer medium include but are not limited to electronic, magnetic, optical, electromagnetic, infrared, RFID, wireless, bluetooth or semiconductor devices that may be random access memory (RAM), read only memory (ROM), erasable programmable read only memory (EPROM or flash memory), compact disc read only memory (CD-ROM), optical storage, magnetic storage or any combination of the above. The terms "memory," "readable medium" and "storage medium" are used interchangeably and refer to any device or component that stores a program for use in a processor controlled device or system and that is in communication with the processor.

A bill validator 155 for accepting paper currency is shown. It is common for EGM 100 to include ticket-in, ticket-out ("TITO") functionality that requires bill validator 155 to perform ticket reading and ticket printing as well as for communication with a central system such as server based system 204 for ticket tracking. For purposes of this description, the terms "bill validator," "bill acceptor," currency validator," "currency acceptor" and "TITO device" will all be used interchangeably. TITO device 155 integrates validation, ticket reading and ticket printing such that it may accept paper bills or coded credits printed on a ticket through slot 120 and for which the value of the credits is displayed on meters 150 upon a ticket being inserted in EGM 100.

The different external systems 200-204 are typically connected to EGM 100 either through a separate interface board (not shown) or directly to different components of EGM 100 including but not limited to game logic board 140. Player tracking system 201, as well as the other systems may require that other components be installed in EGM 100 such as a player tracking display 210, a keypad 215 and a card reader 220. These components allow for direct interaction between EGM 100 and player tracking system 201, as well as the other external systems so that the player may input information on keypad 215 or through use of a card inserted into card reader 220 and display information to the player on display 210. One or more networks 225, 230 are configured between EBS 200, player tracking system 201, other external systems 202-204 and EGM 100. The network may be connected to all EGMs 100 in a casino or any smaller subset of EGMs 100.

Server based system 204 is shown connected to EGMs 100 on network connection 225 which may be a separate connection or the same connection as the network connecting EGM 100 to the other external systems. Server based system 200 may be a single server or it may represent a group of interconnected servers that are configured to be a single system interfacing with a group of EGMs. Server based system 200 may be used to handle various functions including but not limited to downloading game content to EGMs 100, upgrading software on EGM 100, managing TITO ticket tracking and generating and providing random numbers to EGM 100 that are used by EGM 100 as well as other EGMs connected on network 225 for determining game outcomes.

It will be understood that the type of network 225, 230 over which data is communicated among EGM 100 and the external systems can be one of several different types of networks that may be wired or wireless. These include a Local Area Network (LAN), Wide Area Network (WAN), an intranet, the interne or other classes of networks. Any type of network technology could be used without departing from the principles of the invention. This would include communication via any protocol on any of the layers of the OSI model (ISO/IEC 7498-1) with or without encryption (e.g. SSL encryption, VPN, etc.). The time may be synchronized on all components of the system via a network protocol such as, for example, network time protocol ("NTP") to ensure that time stamps may be reliably compared.

Figure 3:
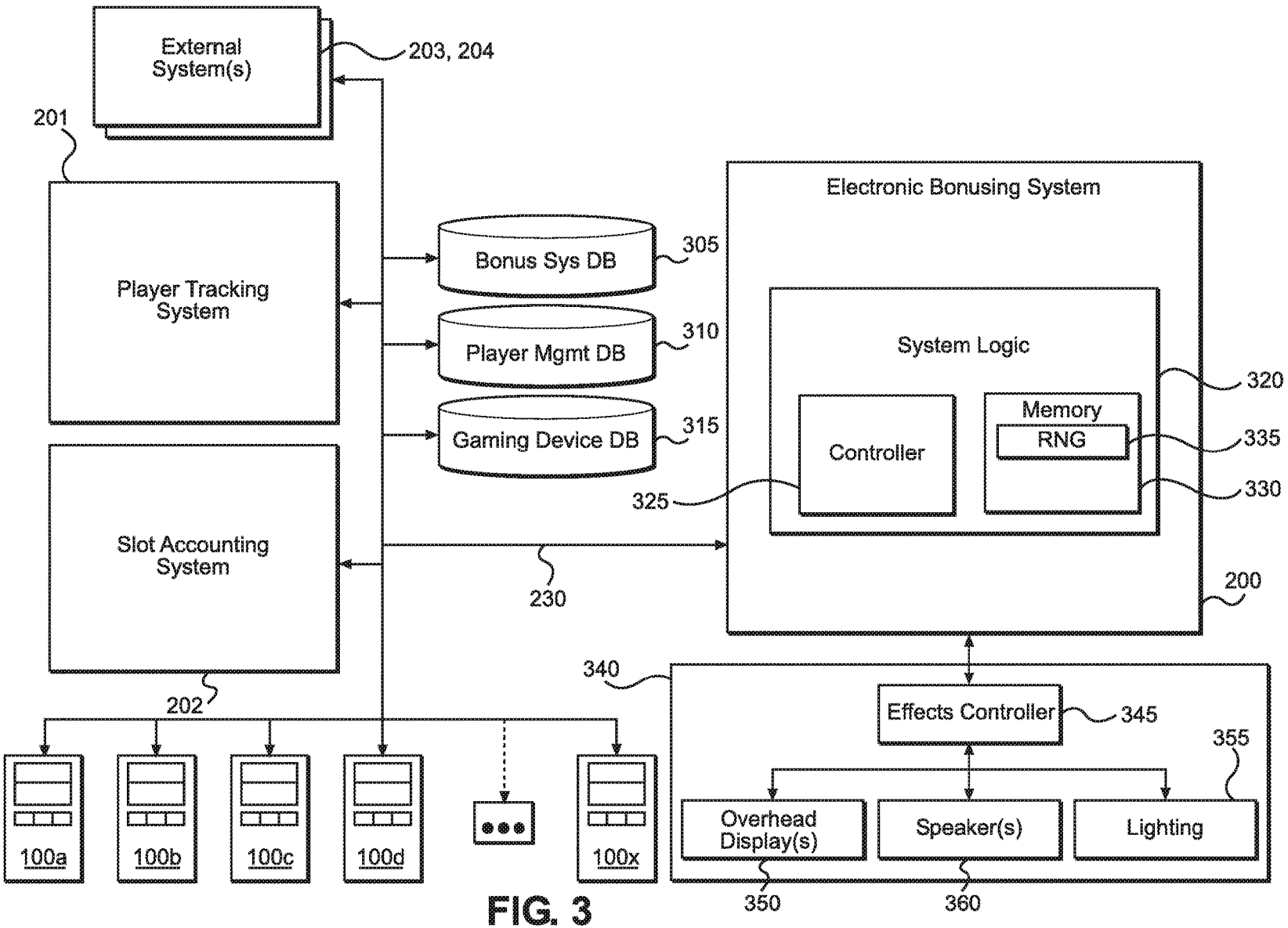
FIG. 3 is a block diagram of the marketing bonus system configured in a network with electronic gaming machines, a player tracking system, a slot accounting system, other external systems and associated databases.

FIG. 3 is a block diagram of EBS 200. EBS 200 is configured in network 230 with EGMs 100*a-x*. EBS 200 allows the award of marketing dollars to a patron account without appreciably or unacceptably delaying or suspending play on an EGM 100 and, in accordance with at least some embodiments, without the need to directly interact with the electronic components of EGM 100. This may allow the gaming device to continue to function as normal without appreciable or unacceptable interruption during a marketing bonusing event on EBS 200.

Other systems on network 230 may include, in accordance with some embodiments, one or more of player tracking system 201, slot accounting system 202 and other external systems 203, 204. A set of databases may also be connected to network 230. A bonus system database 305 is primarily associated with EBS 200 and tracks different types of loyalty awards that are available to be won by players who are eligible for a loyalty award. A player management database 310 is primarily associated with player tracking system ("PTS") 201 and tracks players who are members of the establishment's loyalty program. Upon signing up to be a loyalty program member, the player provides identification information that is entered into player management database 310, such as name, date-of-birth, physical address, email address, phone number and other information that may be of interest to the establishment for marketing purposes.

A gaming device database 315 is primarily associated with slot accounting system 202. Database 315 tracks and manages information related to the EGMs 100*a-x* that are connected on network 230 such as type of machine, manufacturer, currency deposited, payouts made, game activity including games played, wagers placed, win, profitability and other measures typically managed and tracked by PTS 202.

It should be understood that the network may be set up with any number of EGMs that may number into the thousands of machines. Each of EGMs 100*a-x* may also be connected to external systems 203, 204.

EBS 200 is controlled by system logic 320 on a logic board that includes a controller 325 that is typically in the form of a microprocessor that accesses software applications held in memory 330 for operating EBS 200. Memory 330 may be static or dynamic. In memory 330 is a software random number generator ("RNG") 335 that generates and selects random numbers for the purpose of randomly awarding prizes to players on EGMs 100*a-x*.

EBS 200 may further include an integrated or external effects system 340 for delivering different bonus themes that use an effects controller 345 to control visual effects on displays 350 and lighting system 355. Visual and lighting effects may further be accompanied by audio played over speaker system 360. Displays 350 are preferably separate from and external to EGM 100. They may be very large screens that are visible to patrons while playing an EGM as well as other individuals in the establishment. In one embodiment, displays 350 are multiple, large projection units that form a "living" backdrop on the walls behind EGMs 100 *a-x*. In the event a prize is awarded by EBS 200, notification and sequences of themed visual images or a video feed may be shown on display(s) 350, and enhanced with orchestrated lighting effects using lighting system 355 that is configured throughout the establishment where EGMs 100*a-x* are located. In addition, notifications and other instructions may be shown on display(s) 350 as well as on the displays of individual EGMs 100*a-x*. Sounds such as celebratory music or other audio tracks corresponding to the themes coincide with the bonusing event, including leading up to, during and after the time that a prize is awarded. Instructions for receiving a reward may also be provided on speaker(s) 360. Themes may, for example, be a thunderstorm with lightning and rain, a Hawaiian theme or any other theme that can be imagined by the system designer.

In one embodiment of the invention, EGM displays 105, 120, effects system display(s) 350, lighting 355 and speakers 360 are used individually or in combination to provide a pre-notification to individuals present in the establishment informing them that a prize will be awarded at a particular point in time (e.g. "at 9:00 pm-30 minutes from now") or during a predetermined time interval (e.g. "sometime between 9:00-9:30 pm-a 30 minute interval starting 30 minutes from now"). For example, one or more of EGM displays 105, 120, effects system display(s) 350, lighting 355 and speakers 360 may initiate a virtual thunderstorm as the pre-notification event. Players who are regular players may recognize such an event, while new players may need to be prompted with instructions or notified by establishment personnel. Such pre-notifications raise the level of excitement for players and entice members of the loyalty program to initiate play at an EGM where such play session may be detected using card reader 220 associated with player tracking system 201. All or a designated subset of loyalty award players who are engaged in play at the particular point in time when the prize is awarded are eligible to win the prize. Notification of a win may be reported to the winning loyalty program member on one or more of a display 105, 120 on a particular EGM and/or on overhead display(s) 350, lighting 355 and speaker(s) 360.

Eligibility of loyalty program members for a prize may be established for any player actively engaged at an EGM 100 in the establishment at the time a prize is selected and awarded. EBS 200 may, in accordance with some embodiments, be able to determine eligibility by accessing gaming device database 315 in real-time over network 230 to access data set by player tracking system indicating that a player tracking card for a particular loyalty program member is inserted in card reader 220. In other embodiments player eligibility may be determined in another manner (e.g., by accessing data stored in a memory of a player tracking card or stored in another memory accessible to EBS 200).

It is also possible to implement other eligibility requirements for a win (e.g., to narrow the group of eligible loyalty program members for a particular prize). Eligibility requirements may be configured at any time for any particular prize and include, but not be limited to the following examples. In one embodiment, eligibility is limited to any loyalty member who is actively playing an EGM 100 at the time the prize is awarded. It is possible to further narrow eligibility in the case of active play to also require that a loyalty program member have wagered a minimum amount within a time period preceding the award of a prize (e.g. $25 during a 30-minute period preceding the prize) or played some number of games (e.g. 20 games). This type of EGM specific information may be determined or accessed by EBS 200 (e.g., in one embodiment it may be accessed from a storage means accessible to EBS 200, such as a gaming device database 315 which may be updated and tracked (e.g., continually or frequently, such as in real-time) by slot accounting system 202. In another example, a player may be required to have wagered a minimum amount (e.g., a minimum average wager amount per game play, a minimum cumulative wager amount during a relevant preceding period or at least a minimum wager amount for each qualifying game play in the relevant preceding time period). In cases where a minimum play threshold is an eligibility requirement, pre-notification may be a desirable feature of EBS 200 operation because it may be beneficial to encourage players to meet the requirements in order to win the impending prize. If there is no pre-notification in advance of an award, the marketing bonus system is less effective, because while an eligible player may still be awarded for play, nobody will know that a prize is coming and there will be no incentive to get more loyalty members playing EGMs to meet the eligibility requirements.

Other eligibility requirements or factors may also be imposed for different prizes tracked in EBS database 305. Examples include establishing a minimum threshold for: (a) player rank based on play over a period of time; (b) player date of birth; (c) player historical play level; (d) player affinity group membership (e.g. over 60); (e) location of actively played EGM; (f) wager denomination by player; (g) manufacturer of EGM; (h) unique identifier of EGM (e.g. machine type); (i) game type installed on EGM; (j) type of EGM (e.g. video poker, video slot, physical reel slot, etc.); (k) level of play on EGM; (l) level of win on EGM; and/or (m) player address. Such eligibility requirements of factors may be preset by the operator of the establishment and may, in some embodiments, be subject to change at the discretion of the operator. It should be understood that individual prizes may be determined by the operator and may vary based on factors such as site location, time of day, profile of players visiting the establishment or any number of other single or combination of factors that are viewed as positively impacting marketing decisions for the prizes.

In the example of player date of birth, a prize may only be made available to individual program members whose birthday is within a pre-defined number of days from the present day (e.g. 5 days before or 5 days after). This information may be accessible from, for example, player management database 315 or another data source accessible by EBS 200. Another example includes player state or zip code. A "local" prize may be awarded to someone who lives in one or more zip codes surrounding the establishment or anyone visiting from a particular state, which would be known from the loyalty members' addresses maintained in player management database 315. If the establishment operator knows that a group is visiting from a particular town, county, state, region or country (domestic or foreign), awarding of prizes can be tailored to such groups.

By using different types of data related to players that is tracked and managed in player management database 310 and different types of data related to gaming operations for EGMs that is tracked and managed in gaming device database 315, the loyalty program can be leveraged to generate an increased level of excitement for players, resulting in more play for the establishment and more wins for the players.

Other requirement parameters may also be included for prize eligibility. For example, in one embodiment in order for a prize to be awarded, a minimum number of loyalty members must be actively playing EGMs. In that case, a player count may be displayed on overhead displays 350. If the number of active players is below the minimum threshold, it may encourage more players to initiate play, and it may also incentivize active players to encourage their friends to play so that the threshold is met and the prize is awarded. This type of activity may create a community interest for those playing in the establishment as many players may be eager to see the prize awarded and for increased opportunities for someone in the collective group to win.

Prizes awarded by EBS 200 may be determined according to a number of different criteria. For example, in one embodiment the amount of the award may be in a predetermined range and then the particular value can be selected using an RNG. In another embodiment, the prize may steadily increase during a pre-selected time period according to a set formula. In yet another embodiment, the prize may be a non-cash award that is in the form of merchandise or a service. An example of a configuration screen 400 for setting up a bonus is shown in FIG. 4. As can be seen in the configuration screen, the bonus is given a name, in this case "$25 Max Winner Award" (line 1). A minimum amount (e.g. $1.00—line 2) and a maximum amount (e.g. $25.00—line 3) are assigned to the award and the status is shown as "Active" (line 4). In the example, there are three different EGMs on the floor of the casino that are enrolled to win the prize and are numbered 10001, 10002 and 10003 (line 5). A "Device Enrollment Type" (line 6) and a "Device Enrollment Description" (line 7) indicate the way in which a particular machine is eligible. In the example the enrollment description refers to the location of the machines which are identified by a device number. However, other types of identifiers may be used such as a particular EGM manufacturer or EGM type (e.g. slot, poker, keno, name of game, etc.).

A pre-notification minimum (20 minutes—line 8) and maximum (100 minutes—line 9) as well as notification minimum (2 minutes—line 10) and maximum (4 minutes—line 11), are set to define the different times for the next event. In accordance with some embodiments, an RNG is used to select the actual pre-notification time for running a special attract mode of sights and sounds for alerting players of the upcoming bonus, where the time is between the boundaries as defined for both the pre-notification. Notification time is the range of times within which a bonus is awarded once the pre-notification period expires. The notification time may, in some embodiments, be selected at random by an RNG.

A bonus trigger name (Every 20 Minutes Minimum—line 12) and period minimum (20 minutes—line 13) define the minimum period between a win of the previous bonus and the amount of time until the next bonus event begins. The time range bounded by bonus minimum time (Jan. 1, 2016—line 14) and bonus maximum time (Jan. 1, 2020—line 15) are also defined by the operator to set an ongoing bonusing event to automatically occur.

FIG. 5 is an example of an enrollment screen 500 that, in at least some embodiments, allows the operator to set up particular machines or machine types for eligibility for bonus awards (a bonus award being a prize or benefit to be awarded or provided to a payer as a result of a bonus event as described herein, the terms bonus award and prize being used interchangeably herein). One or more of the different enrollment criteria listed can be selected. For example, a bonus named "$25 Max Winner Account" (line 1) is set and the criteria for eligibility in this case are that a machine be a slot type EGM (line 6) with a video display (line 7) and that it not be leased (line 8). Other criteria may also be used such as denomination ("Denom"—line 2), Location (line 3), EGM Manufacturer (line 4), PAR (line 5), description (line 9) and asset ID (line 10).

FIG. 6 is an example of an activate screen 600, which in some embodiments may be made available to an operator for setting time criteria for particular bonuses. The activate screen names the bonus (line 1) and then lists start and end times for each day of the week (lines 2-15). In this example, the bonuses are active 24 hours a day from midnight (00:00:00 am) each day until (11:59:59 pm) that same day. It should be understood that the time ranges for each day may be changed to set bonus activity for any given day of the week.

FIG. 7 is an example of a bonus monitor screen 700 that may be made available, in accordance with some embodiments, to an operator for monitoring the status of bonuses in real-time. In the screenshot of FIG. 7, the bonus monitor shows the bonus "$25 Max Winner Amount" (line 1) on Jul. 1, 2016. The pre-notification time (line 3) is 05:56 and the award time (line 4) is set four minutes later at 06:00. In this case, a winner has already been established and a full set of information is provided in the device enrollment block (line 6) including Machine Number (14305), Denomination (0.0100), EGM manufacturer (IGT), EGM Description (Multi-Game-MD 5-17), Par (10.480), Game Type (Poker), Display Type (Video), etc.

The current floor view (line 7) includes the bonus location, the playerID, the time the identification card was inserted, the name and other information. Other information is also shown including current bonus ID (line 2), minimum distinct cards (line 5), winner playerID (line 8), winner name (line 9), winner location (line 10), winner amount (line 11), winner award date/time (line 12), bonus status (line 13), last update to record (line 14) and bonus maximum time (line 15).

Figure 8:
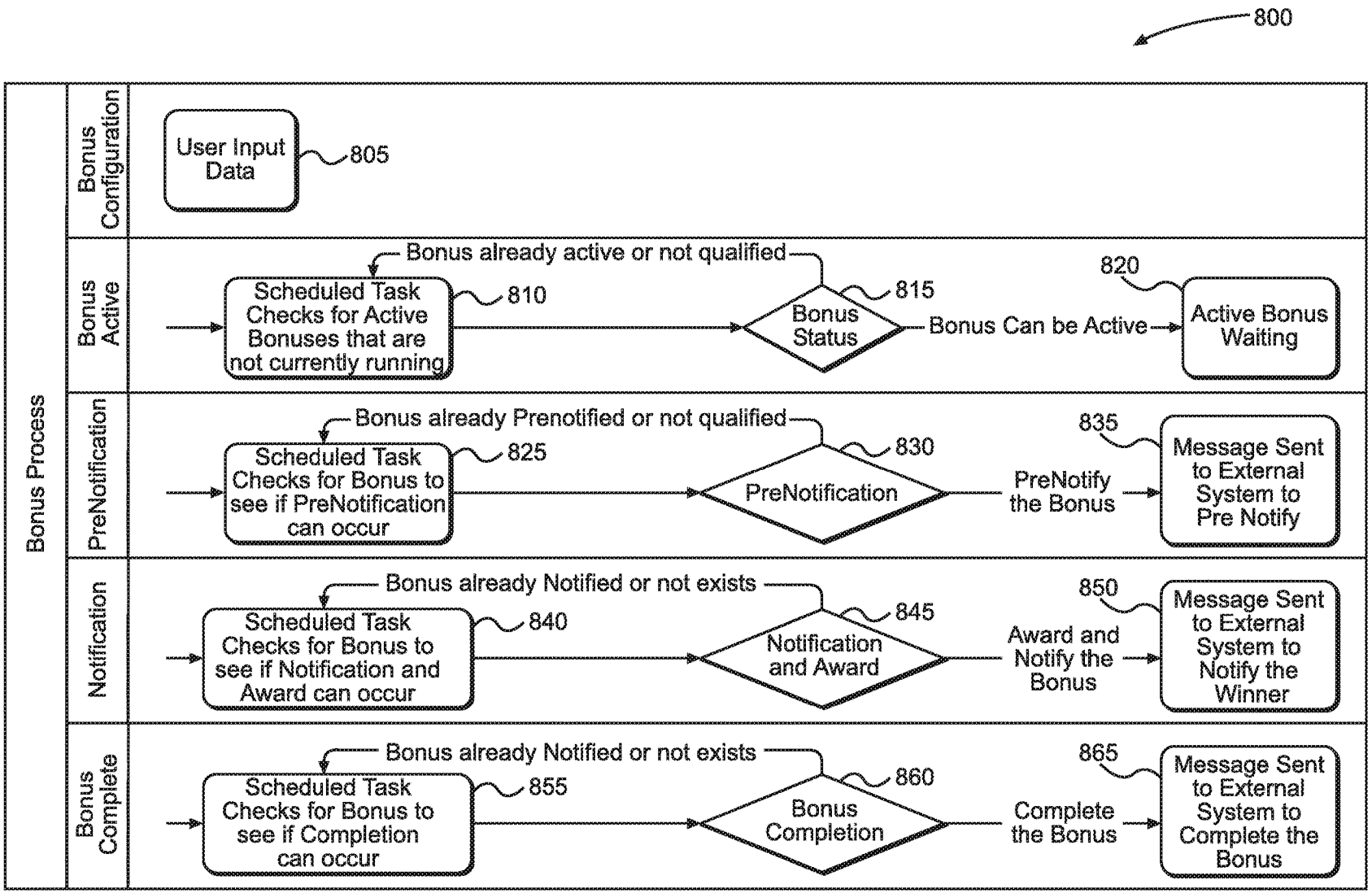
FIG. 8 is a bonus process state diagram for a marketing bonus system.

FIG. 8 is a bonus process state diagram 800, consistent with some embodiments. As can be seen, the bonus is created from a timed job that checks the configurations as shown in FIG. 4 to see whether a new bonus is to be created. If appropriate a new bonus will be configured with specified values and created by the RNG as part of the new bonus event. Once a bonus is configured and created at 805, the bonus becomes active and it is determined whether the active bonus is currently running at step 810. Bonus status is continually checked at step 815, and as long as the bonus is either not yet qualified or not running, the bonus is in an active bonus waiting state as indicated at step 820. In addition to the timing and eligibility for a particular bonus, the bonus may also be configured with distinctive lighting on lighting system 355, sounds on speakers 360 and visual images on displays 350. For example, the bonus may be a thunderstorm theme with appropriate thunder clap sounds and rain, as well as visual effects of a darkening sky using lighting and screen displays. As another example, the bonus may be a Hawaiian tropical theme with soothing music and rainbows.

Once a bonus goes active, the pre-notification process is triggered at step 825. If the bonus becomes active and pre-notification has not yet been provided, pre-notification is queued at step 830 and a message is sent to the EBS to pre-notify at step 835. Once pre-notification is complete, eligible EGMs are in play and players continue to play. During the bonus cycle, a continuous status check is made to ensure that notification of a prize to be awarded can occur at step 840. Once RNG 335 on EBS 200 delivers a winning number, notification of the award occurs at step 845, and a message is transmitted to EGM 100 and to the external display system at step 850 to notify the winner. The awarding of the bonus is accompanied by the sounds and visuals for the particular bonus theme both on EGM 100 and as provided by effects system 340 controlling speakers 360, lighting 355 and external displays 350. Finally, after the player is notified of the win, the scheduled task checks the status of the bonus to see if the bonus cycle can be completed at step 855. If so, the bonus is completed at step 860 and a message is transmitted to the external system at step 865 confirming that the bonus is complete. Effects system 340 returns to normal lighting and visuals on the external displays as well as sounds from the speakers.

Figure 9:
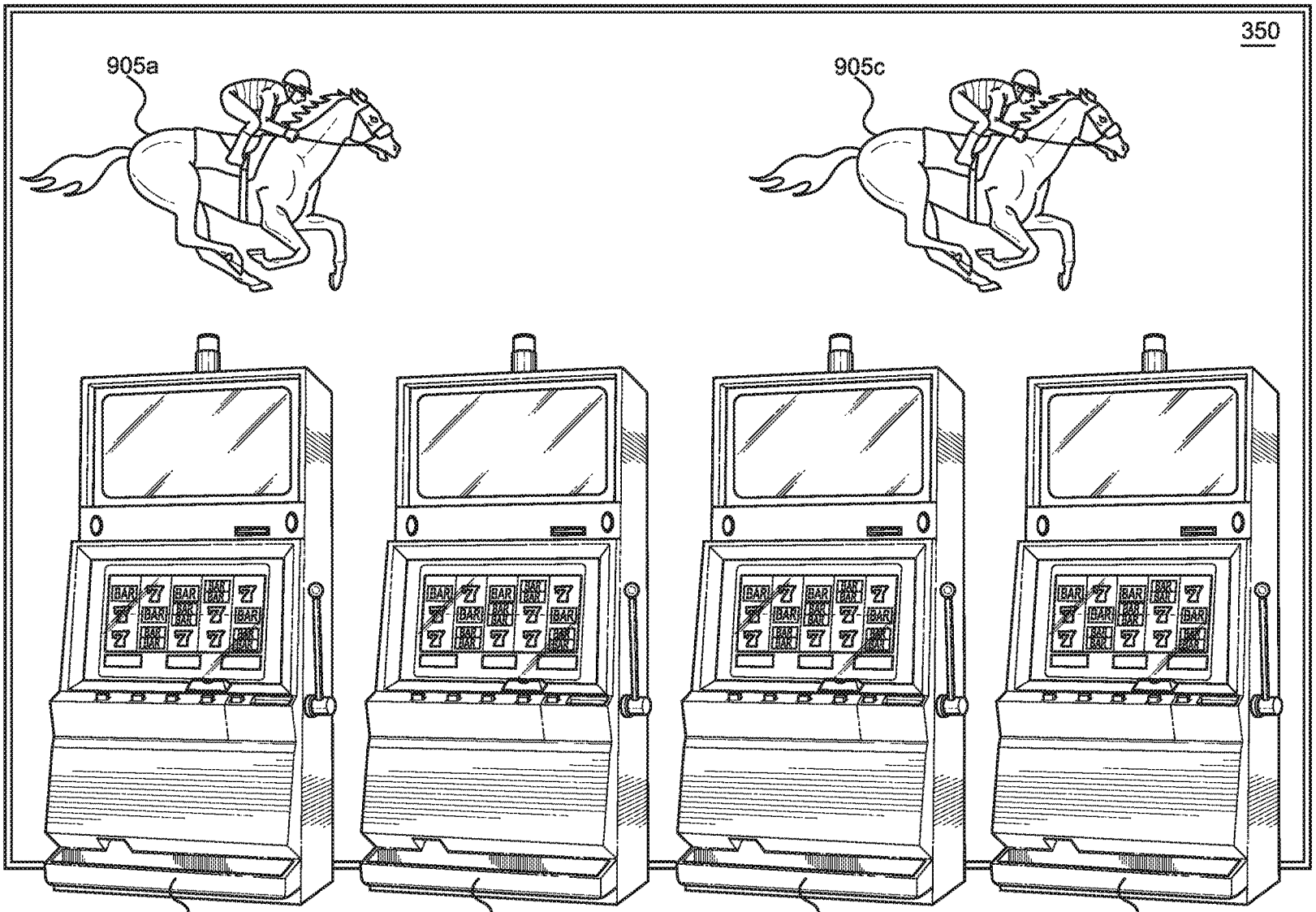
FIG. 9 is a display over an electronic gaming machine showing participation in a bonus event on a marketing bonus system.

FIG. 9 is an example of a display 350 which is an example of a component of effects system 340. Display 350 is positioned over or behind a group of EGMs 100*a-d* although it can be located anywhere in the establishment. In FIG. 9, display 350 is being used to show visual images representing player participation in a bonus event using a live data feed or a recorded data feed. The visual representation of play may be accompanied by lighting and sound effects on effects system 340 while the bonus game is conducted on EGMs 100*a-d*.

In accordance with some embodiments, a bonus game or bonus event may be based on a live event or a recorded data feed of a live event (e.g., a horse race, a NASCAR® race or another sporting event). In such embodiments, display 350 may be utilized to output a video and/or audio feed of the live event or a recorded data feed of a live event. The visual aspects of the live or recorded data feed on display 350 provide an exciting representation that gives players the sense that they have a stake in the event, whether it is a horse race as shown, a baseball game, another sporting match or any other representative competition between different teams, individuals or other competitors where one or more participants wins. As the players continue to play at their respective EGM, they are able to see the bonus event competition unfold until the outcome of the event is determined and the winner of the bonus event is revealed. In this case, the bonus is shown in the form of a horse race where horses 905*a*, 905*c* are shown above EGMs 100*a*, 100*c* respectively that are eligible to participate in the bonus event. Winners are selected and, in at least some embodiments, there can be multiple winners per event and multiple events.

In accordance with some embodiments, as described herein, the bonus systems and processes may be designed to engage the player by providing a pre-notification of the bonus event, even when the bonus event is based on a live event or a recorded data feed of a live event (both the data depicting a live event as it is occurring and the recorded data feed of a live event being referred to as "live event data" herein). The pre-notification may occur via a pre-notification period, which has a start time and an end time and during which pre-notification period player may join or adjust game play in order to satisfy the one or more requirements for being eligible for a bonus award to be awarded upon the pre-notification period ending (i.e., after or upon the end time of the pre-notification period). In accordance with some embodiments, pre-notification is the mechanism that is used to communicate to players information such as (i) that at least one award is to be awarded at the end of the pre-notification period; (ii) that an event is eligible for entry and that a winner will be selected in the near future; (iii) that eligibility of players is being reviewed by the system such that at least one award will be awarded to one or more players who are considered to have met, by the end of the pre-notification period, any requirements associated with the award.

In accordance with some embodiments, once a pre-notification period ends: (i) additional players may not be added to the pool of players considered to be eligible for a bonus award to be awarded based on the live event; and (ii) one or more awards based on the live event may be awarded. It should be noted that both a live event and a pre-recording of a live event are collectively referred to as a "live event" herein.

In accordance with some embodiments, an end time and/or a start time for a pre-notification period associated with a live event may be based on one or more events or statuses associated with or based on the live event. In accordance with some non-limiting examples, an end time for a pre-notification period associated with a particular live event upon which a bonus award is determined may comprise or be based on at least one of: (i) the time the live event begins (e.g., assuming the live event is a race, the pre-notification period ends once the race begins, such that players may continue to qualify for the award to be awarded based on the live event up to the beginning of the race); (ii) the time the live event ends (e.g., assuming the live event is a race, the pre-notification period ends once the race ends, such that players may continue to qualify for the award to be awarded based on the live event up to the end of the race); (iii) the time the live event enters a predetermined status (e.g., the pre-notification period ends upon a starting sound or other indicator of the race being detected or when the lead racer is determined to have entered the last lap); or (iv) within a pre-determined time, either before or after, a predetermined event of the live event (e.g., assuming the live event is a race, the pre-notification period ends thirty seconds before or thirty seconds after the race begins or thirty seconds before the race ends or is expected to end).

Similarly, the pre-notification period may begin (or a start time of the pre-notification period may be determined to be) based upon one or more of the following example times or events associated with the live event: (i) a predetermined time before a start or expected start of the live event (e.g., assuming the live event is a race, the pre-notification period may start five minutes prior to a start or expected start of the race); or (ii) upon the live event entering a pre-determined status (e.g., assuming the live event is a race, the pre-notification period may start upon determining that the command "Drivers start your engines" has been delivered or warm-up laps of the race have commenced).

In accordance with some embodiments, a bonus award may be awarded during the pre-notification period in addition to, or in lieu of, being awarded at the end of the pre-notification period. In one embodiment, the bonus award may be awarded right at the end of the live event or the end of the pre-notification period (if different from the end of the live event), such that the time for the awarding of the at least one award coincides with the end of the live event.

In accordance with some embodiments, the awarding of a bonus award during, at the end of, or after the pre-notification period may be based on a result of the live event. For example, in accordance with embodiments each eligible player (or each EGM being played by an eligible player) may be assigned to or associated with a participant of the live event (e.g., a particular car in a car race, a particular horse in a horse race, a particular player in a soccer game, a particular runner in a foot race, etc.). Such an assignment may, in some embodiments, be done randomly (e.g., based on an output of an RNG or other algorithm) while in other embodiments an eligible player may be able to select the participant they would like. In one embodiment, multiple EGMs may be assigned to the same live game participant (e.g., multiple EGMs may be assigned to the same racecar or other race participant) or multiple eligible players may be allowed to select the same live game participant, thus allowing for multiple bonus award winners based on the same live event result.

In accordance with some embodiments, a bonus award is awarded to each eligible player who corresponds to a qualifying participant of the live event or the participant who satisfies a qualifying condition for awarding the bonus award (e.g., a participant that satisfies a bonus awarding condition, thus qualifying the eligible player corresponding to that participant to receive a bonus award as a result of the live event). For example, if the live event comprises a soccer game, the EGM player of an EGM that corresponds to a soccer player that scores a goal may receive an award each time the soccer player scores a goal or make an assist (or gain possession of the ball). In a race-type of live event, bonus awards may be awarded to qualifying players of the EGMs that correspond, at the end of the live event, to the winner(s) of the live event or the top X placers/participants in the live event (e.g., the top five cars or the first racers or horses to pass the finish line). In yet another example, the qualifying condition may be relative to the other live event participants assigned to eligible players for the current bonus event. For example, an eligible player corresponding to a particular live event participant (e.g., a particular racecar if the live event is a car race) may be selected as a winning player and thus be provided with a bonus award if the particular participant places best in the race out of all the live event participants assigned to eligible players for the current event, even if the particular live event participant didn't win the race. Returning to the race car example, an eligible player of a bonus event may be selected as a winning player and win a bonus award as a result of the bonus event if the racecar assigned to him/her for that bonus event places best out of all the racecars assigned to eligible players for that bonus event, even if his/her racecar did not win the race (or is one of the top X best of all the assigned racecars, if more than one bonus award is being awarded). In some embodiments, an operator of a gaming establishment or participating EGMs may be able to set the bonus awarding conditions for a live event and/or the values/magnitude of each bonus award to be awarded upon a corresponding bonus awarding condition being satisfied.

In accordance with one non-limiting example in which the live event comprises a NASCAR® race, the pre-notification period may comprise a period of time between a pre-determined time before the race begins and an end of the race, such that players may be notified starting before a pre-determined period of time before the race begins and all throughout the race until the race ends that a bonus event is about to happen and that at least one winner of at least one award will be selected before the end of the race or to coincide with the end of the race.

In one embodiment, photos, videos or other representations of the live event based upon which one or more bonus awards are to be awarded may be displayed to players throughout a gaming establishment. In one embodiment, a photo, picture or other representation of the particular live game participant (e.g., race car, horse, human competitor, etc.) assigned to a particular EGM may be displayed on a display device at, near or associated with the EGM. For example, returning again to the NASCAR® race example, in one implementation depictions of a certain number (e.g., 10) NASCAR® racecars may be displayed within a gaming establishment, such as over the EGMs participating in an upcoming bonus event. During a pre-notification period, one of these cars may be selected and assigned to each EGM being played by an eligible player (i.e., a player who is eligible to win a bonus award based on the live event comprising a NASCAR® race). At the end of the pre-notification period (or, in some embodiments, during the pre-notification period) the eligible player playing at the EGM corresponding to the winning racecar or to the racecar corresponding to the bonus awarding condition for the live event (e.g., the first X (e.g., three) racecars to cross the finish line), is awarded a bonus award. In some embodiments, more than one EGM may be assigned to a particular racecar such that multiple players may be awarded a bonus award if that particular racecar is the winning racecar.

In accordance with some embodiments, an eligible player may not be informed, prior to the end of the pre-notification period, which participant of a live event (e.g., racecar, if the live event is a car race) he/she is assigned to, thus allowing for a mystery and reveal at the end of the pre-notification period or otherwise upon a bonus award being awarded. In such an embodiment, the indication or representation on a display corresponding to a particular participating EGM may output or display a random participant (e.g., random race car) or alternate which live event participants (e.g., which racecars) are displayed, rather than displaying the particular live event participant corresponding to that EGM.

In accordance with some embodiments, as described herein, the outcome of a bonus event (e.g., to whom the bonus award is provided and/or the value of the award) may be based on or dependent upon an outcome of the live event. In other embodiments, the determination of the eligible player(s) to whom a bonus award is provided at the end of a pre-notification period (or during a pre-notification period, depending on the embodiment) and/or the value of the bonus award may be randomly determined.

While various embodiments of the invention have been described with respect to the figures, it will be appreciated that many modifications and changes may be made by those skilled in the art without departing from the spirit of the embodiments of the invention. For example, EBS 200 may be connected to EGMs across multiple gaming sites. Any variation and derivation from the above description and drawings are included in the scope of the present invention as defined by the claims.

What is claimed is:

1. A system for awarding a prize for a bonus event to a player of an electronic gaming machine ("EGM") participating in the active play of the EGM indicated by the use of an identifier, comprising:

a network;

a bonusing system connected to the network, comprising:

a controller for controlling system operations in the bonusing system including determining prize selections and including receiving input from a plurality of electronic gaming machines ("EGMs") connected to the network;

a memory for storing software accessible by the controller that provides instructions for operating the bonusing system;

a first bonus system display for displaying information related to bonusing system operations including displaying, during a pre-notification period, a pre-notification of an upcoming prize to be awarded to at least one player wherein the pre-notification is provided in advance of the prize being determined and awarded, wherein the prize is awarded once the pre-notification period expires;

wherein the controller is operable with the memory to facilitate a bonus event associated with a live event by awarding, upon an end of the pre-notification period for the bonus event, at least one prize to at least one eligible player by:

outputting, during the pre-notification period and on a second bonus system display, a representation of the live event;

determining, during the pre-notification period, which of the plurality of EGMs is being played by a player eligible to participate in the bonus event, thereby identifying at least one eligible player and a corresponding eligible EGM;

determining an end of the pre-notification period, wherein the end of the pre-notification period corresponds to an occurrence in the live event;

determining a result of the live event;

selecting, out of the at least one eligible players and based on the result of the live event, a winning player to be awarded a prize for the bonus event, wherein the winning player is awarded the prize based on the result of the live event, and not based on an outcome of game activity on the eligible EGM corresponding to the at least one eligible player that has been selected; and transmitting a signal to the eligible EGM corresponding to the selected eligible player, the signal indicating the prize to be awarded.

2. The system of claim 1, wherein the occurrence in the live event comprises at least one of:

(i) an end of the live event;

(ii) a predetermined period of time prior to at least one of an end and an expected end of the live event; and (iii) a status of the live event.

3. The system of claim 1, wherein the controller is further operable with the memory to:

output a visual indication of the live event.

4. The system of claim 3, wherein the visual indication is at least one of a live video feed of the live event and a recorded video feed of the live event.

5. The system of claim 1, wherein the first display is the second display.

6. The system of claim 1, wherein the controller is further operable with the memory to:

determine at least one participant of the live event; and assign the at least one participant of the live event to a particular at least one player of the at least one eligible players; and wherein selecting the at least one eligible players as a winning player comprises:

selecting the at least one particular player of the at least one eligible players as the winning player upon determining that the at least one participant of the live event that has been assigned to the at least one particular player has achieved a qualifying condition in the live event.

7. The system of claim 1, wherein the qualifying condition comprises winning the live event.

8. The system of claim 1, wherein the controller is operable to communicate with a random number generator ("RNG") for generating random numbers and wherein selecting the winning player comprises selecting the winning player based partly on an output of the RNG and partly on a result of the live event.

9. The system of claim 1 wherein a prize award notice is transmitted to the winning player through an interface on the eligible EGM being played by the winning player.

10. The system of claim 1 wherein a value of the prize is configurable based on operator defined values.

11. The system of claim 1 wherein multiple levels of prizes are available to be won by players at a particular time.

12. The system of claim 1 wherein timing to display a win of the prize via at least one of an interface an EGM, the first display and the second display is configurable.

13. The system of claim 1 wherein a minimum number of players must be eligible before the prize is won.

14. The system of claim 1 wherein a frequency of awarding prizes is configurable based on operator defined values.

15. The system of claim 1 wherein a probability that an eligible player will win the prize is based on one or more factors from the group comprising: (a) player rank; (b) player's date of birth; (c) player's historical play level; (d) player affinity group affiliations; (e) location of EGM within which a player card is active; (f) wager denomination by player; (g) manufacturer of EGM within which a player card is active; (h) unique identifier of EGM within which a player card is active; (i) game type installed on EGM within which a player card is active; (j) type of EGM within which a player card is active; (k) level of play on EGM within which a player card is active; (l) level of win on EGM within which a player card is active.

16. A method for awarding a prize during a bonus event available to a plurality of participating electronic gaming machines ("EGMs"), the method comprising:

displaying, via a first bonus system display for displaying information related to a bonus event and during a pre-notification period, a pre-notification of an upcoming prize to be awarded to at least one player, wherein the pre-notification is provided in advance of the prize being determined and awarded, wherein the prize is awarded once the pre-notification period expires;

wherein the bonus event is associated with a live event and wherein a prize for the bonus event is awarded, upon an end of the pre-notification period for the bonus event, to at least one eligible player by:

outputting, during the pre-notification period and on a second bonus system display, an indication of the live event;

determining, during the pre-notification period, which of the plurality of EGMs is being played by a player eligible to participate in the bonus event, thereby identifying at least one eligible player and a corresponding eligible EGM;

determining an end of the pre-notification period, wherein the end of the pre-notification period corresponds to an occurrence in the live event;

determining a result of the live event;

selecting, out of the at least one eligible players and based on the result of the live event, a winning player to be awarded the prize for the bonus event, wherein the winning player is awarded the prize based on the result of the live event, and not based on an outcome of game activity on the eligible EGM corresponding to the at least one eligible player that has been selected; and transmitting a signal to the eligible EGM corresponding to the selected eligible player, the signal indicating the prize to be awarded.

17. The method of claim 16, wherein the occurrence in the live event comprises at least one of:

(i) an end of the live event;

(ii) a predetermined period of time prior to at least one of an end and an expected end of the live event; and (iii) a status of the live event.

18. The method of claim 16, wherein the controller is further operable with the memory to:

output a visual indication of the live event.

19. The method of claim 18, wherein the visual indication is at least one of a live video feed of the live event and a recorded video feed of the live event.

20. The method of claim 16, wherein the first display is the second display.

21. The method of claim 16, further comprising:

determining at least one participant of the live event; and assigning the at least one participant of the live event to a particular at least one player of the at least one eligible players; and wherein selecting the at least one eligible players as a winning player comprises:

selecting the at least one particular player of the at least one eligible players as the winning player upon determining that the at least one participant of the live event that has been assigned to the at least one particular player has achieved a qualifying condition in the live event.

22. The method of claim 16, wherein the qualifying condition comprises winning the live event.

23. The method of claim 16, further comprising:

communicating with a random number generator ("RNG") for generating random numbers and wherein selecting the winning player comprises selecting the winning player based partly on an output of the RNG and partly on a result of the live event.

* * * * *